United States Patent [19]

Chromy et al.

[11] 4,051,990

[45] Oct. 4, 1977

[54] DEVICE FOR SECURING AN EXPANSION ANCHOR

[75] Inventors: Franz Chromy, Feldkirch-Levis, Austria; Walter Winkler, Gams, Switzerland; Manfred Mähr, Schlins; Fritz Mark, Mader, both of Austria

[73] Assignee: Hilti Aktiengesellschaft, Schaan, Liechtenstein

[21] Appl. No.: 592,348

[22] Filed: July 1, 1975

[30] Foreign Application Priority Data

July 8, 1974 Germany ..... 2432642

[51] Int. Cl.[2] ..... B25C 1/14

[52] U.S. Cl. ..... 227/10

[58] Field of Search ..... 227/10, 11, 120, 149, 227/156; 29/522, 523

[56] References Cited

U.S. PATENT DOCUMENTS

| | | | |
|---|---|---|---|
| 2,707,897 | 5/1955 | Beeson | 29/523 |
| 3,104,396 | 9/1963 | Termet | 227/149 |
| 3,357,617 | 12/1967 | Osborne | 227/149 |
| 3,615,049 | 10/1971 | Obergfell et al. | 227/120 |
| 3,786,980 | 1/1974 | Passer | 227/10 |

*Primary Examiner*—Granville Y. Custer, Jr.
*Attorney, Agent, or Firm*—Toren, McGeady and Stanger

[57] ABSTRACT

For securing an expansion anchor formed of an anchor sleeve and an expansion element into a prepared hole in a receiving material, a conventional piston type explosive powder charge driven setting gun is adapted to hold individual anchors in a guide member mounted on the gun and then by means of a combined sleeve-like piston guide and piston mounted within the guide member to insert the anchor from the guide member into the prepared hole and to drive the expansion element into the anchor sleeve for firmly securing the anchor within the hole.

12 Claims, 6 Drawing Figures

28
3b
16
15
18
3a
2
22
26
24
23
4
11
9
20
20b
20a
21
IV
IV
1
19
17
14
3
13
12
5
20
7
6
20
8
29

DEVICE FOR SECURING AN EXPANSION ANCHOR

SUMMARY OF THE INVENTION

The present invention is directed to securing expansion anchors in place and, more particularly, it concerns a device for inserting and securing the expansion anchors into prepared holes in a receiving material.

Attachments to a receiving material are preferably made by means of dowels when high anchoring values are required. In particular, high anchoring values can be obtained with expansion dowels or anchors which are secured into prepared holes formed in the receiving material by radially widening an anchor sleeve by means of an expansion element.

It has been known to initially insert an anchor sleeve into a prepared hole and then to place an expansion element into the sleeve and then expand the sleeve by driving the element in the axial direction. In such a procedure an auxiliary device is used which supplies individual expansion elements from a magazine into the anchor sleeves and then effects the movement of the elements into expanding engagement with the sleeves.

A considerable disadvantage of such a method is the great waste of time involved, since the introduction of the anchor sleeve and the expansion element and the subsequent spreading of the anchor sleeve are effected manually in the different steps of the operation. Manually spreading an anchor sleeve is often very difficult, especially when the anchor is to be secured in a hard receiving material, such as concrete, because of the great energy expenditure required.

Another disadvantage of this method occurs when the anchor sleeves are inserted into a downwardly opening hole, for example, a hole in a ceiling or roof, where the sleeve is likely to fall out of the hole before it is anchored. To prevent such displacement of the anchor sleeves, there must be some holding action provided before the expansion element is driven into the sleeve.

The present invention concerns a solution to the problems experienced in the past and involves a device for effecting the practical and reliable setting of expansion anchors within prepared holes.

In accordance with the present invention, an expansion anchor formed of an anchor sleeve and an expansion element assembled together are held in a guide member mounted on a setting gun and initially the anchor is displaced partly from the guide member so that it can be aligned with and partly inserted into a prepared hole. Subsequently, a piston guide and piston also located within the setting gun and associated with the guide member effect the completion of the movement of the anchor into the prepared hole and the displacement of the expansion element into the anchor sleeve to afford the final securing action.

By inserting the anchor sleeve and the expansion element into the prepared hole at the same time, the handling of the anchor is especially simplified and considerable time saving is achieved. Immediately following its insertion into the prepared hole, the anchor sleeve is secured to the hole without having to hold the sleeve in the hole to prevent against its dropping out such as one used in ceiling holes and the like.

Another feature of the invention is the use of the force generated by an explosive powder charge when it is ignited for driving the expansion element into the anchor sleeve by means of the piston in the setting gun. In such an operation, the dowels can be secured into a hard receiving material without any manual effort. Further, maximum expansion of the anchor sleeve can be achieved with consequently high anchoring values.

In carrying out such an anchor inserting operation it is preferable to use an explosive powder charge driven setting gun of the piston type. In such a setting gun, a guide member is displaceably mounted in the gun housing and is arranged to receive and hold individual expansion anchors. A piston assembly is provided within the gun housing and associated with the guide member for initially partly displacing the anchor from the guide member and then fully inserting it into a prepared hole and driving the expansion element into the sleeve for anchoring it within the hole.

Such a device facilitates the introduction of an assembled expansion anchor into a prepared hole. The guide member holds the assembled anchor in position for insertion into a hole, that is, with its longitudinal axis in the driving direction and prevents accidental displacement of the anchor. The anchor is ejected from the guide member by the piston assembly which for the sake of simplicity is constructed as a sleeve arranged in the setting gun for limited axial movement with the forward end of the sleeve having an outside diameter corresponding to the outside diameter of the rear or trailing end face of the anchor sleeve. Further, the piston sleeve acts as a gun barrel with the piston displaceable through it into contact with the expansion element of the assembled anchor. It is possible to construct the piston sleeve of a single part or to dividie it into a number of parts. The piston also has a limited axial displacement relative to the piston sleeve through which it moves in the axial direction. The front end of the piston has a cross-section which is smaller than the corresponding cross-section of the bore of the anchor sleeve. After the anchor is introduced into the prepared hole, the explosive powder charge is ignited which propels the piston against the expansion element and drives it into spreading engagement with the anchor sleeve so that the anchoring position is achieved without any appreciable manual effort. A disengageable stop is mounted in the housing and engages a groove in the guide member to limit the rearward movement of the guide member relative to the housing. At the position where the stop limits the rearward movement of the guide member, a partial displacement of the expansion anchor is achieved from the forward end of the guide member. With a portion of the expansion anchor projecting from the guide member and the rest held within the member, it is possible to introduce the projecting part into a prepared hole. By disengaging the stop, further relative movement can be attained between the housing and the guide member with the guide member riding rearwardly over the piston sleeve so that the expansion anchor is fully advanced from the guide member into the prepared hole. These relative movements are achieved by pressing the front end of the guide member against the surface of the receiving material containing the prepared hole. Though a pin engageable in an axially extending groove is suitable for use as the disengageable stop, other movable mountings or similar elements can also be used.

To assure that the assembly of the piston and piston sleeve do not damage the female thread in the traling end of the expansion anchor due to acceleration when a cartridge is fired within the gun, the piston projects slightly outwardly from the front end face of the piston sleeve before the ignition of the explosive powder propellent charge. Accordingly, when the setting gun is in position to insert an expansion anchor, the front end of the piston projects slightly into the trailing end of the expansion anchor bore so that a centering action is obtained.

Preferably, the guide member is formed as a tubular section with an axially extending bore having a cross-section sufficient to receive and guide the expansion anchor. Such a tubular member has the advantage that it is simple to produce at low costs and is relatively stable.

There is always the possibility that an expansion anchor once inserted into the guide member may drop out, particularly if the setting gun is held with the muzzle pointed downwardly. Therefore, another feature of the invention is the provision of a retaining catch, for instance, a ball catch, in the end of the bore in the guide member for preventing an inserted expansion anchor from falling out.

If the expansion anchors are introduced through the muzzle end of the gun into the guide member, there is always the risk that a person standing in front of the gun might be injured in the event of a misfire. To prevent such an occurrence, the guide member, at a position spaced from the muzzle opening, has a lateral opening for introducing an expansion anchor into the bore of the guide member oriented in the firing direction. Accordingly, with such an arrangement it is necessary that the piston assembly be positionable rearwardly of the opening into the guide member bore. To introduce the expansion anchors into the bore, a feed duct or magazine is mounted on the guide member with a passage arranged to contain a number of expansion anchors for insertion into the guide member. Accordingly, instead of manually inserting the expansion anchors, they can be inserted one at a time through the opening in the guide member into position to be inserted into a prepared hole. This magazine arrangement saves additional time in the operation of the setting gun.

To simplify and facilitate the insertion of the expansion anchors into the guide member, a biasing member is located in the magazine. The biasing member displaces the individual expansion anchors through the opening in the guide member into its bore and prevents the anchors once inserted, from falling out of the bore through the opening in the guide member. The biasing member can be arranged to work automatically or manually. To permit reloading of the magazine with expansion anchors, the biasing member must be removable from the magazine. To afford this characteristic, the magazine has a suitable guide groove for the biasing member.

Another feature of the invention is the provision of a spring to provide the biasing action to the member when it is used for automatic feeding of the expansion anchors. Particularly suitable for use as such a tensioning member, because of its low space requirement, is a strip formed of rubber or spring steel which is attached to the biasing member and coils about a shaft as the individual anchors are moved through the passage in the feed duct or magazine into the guide member.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
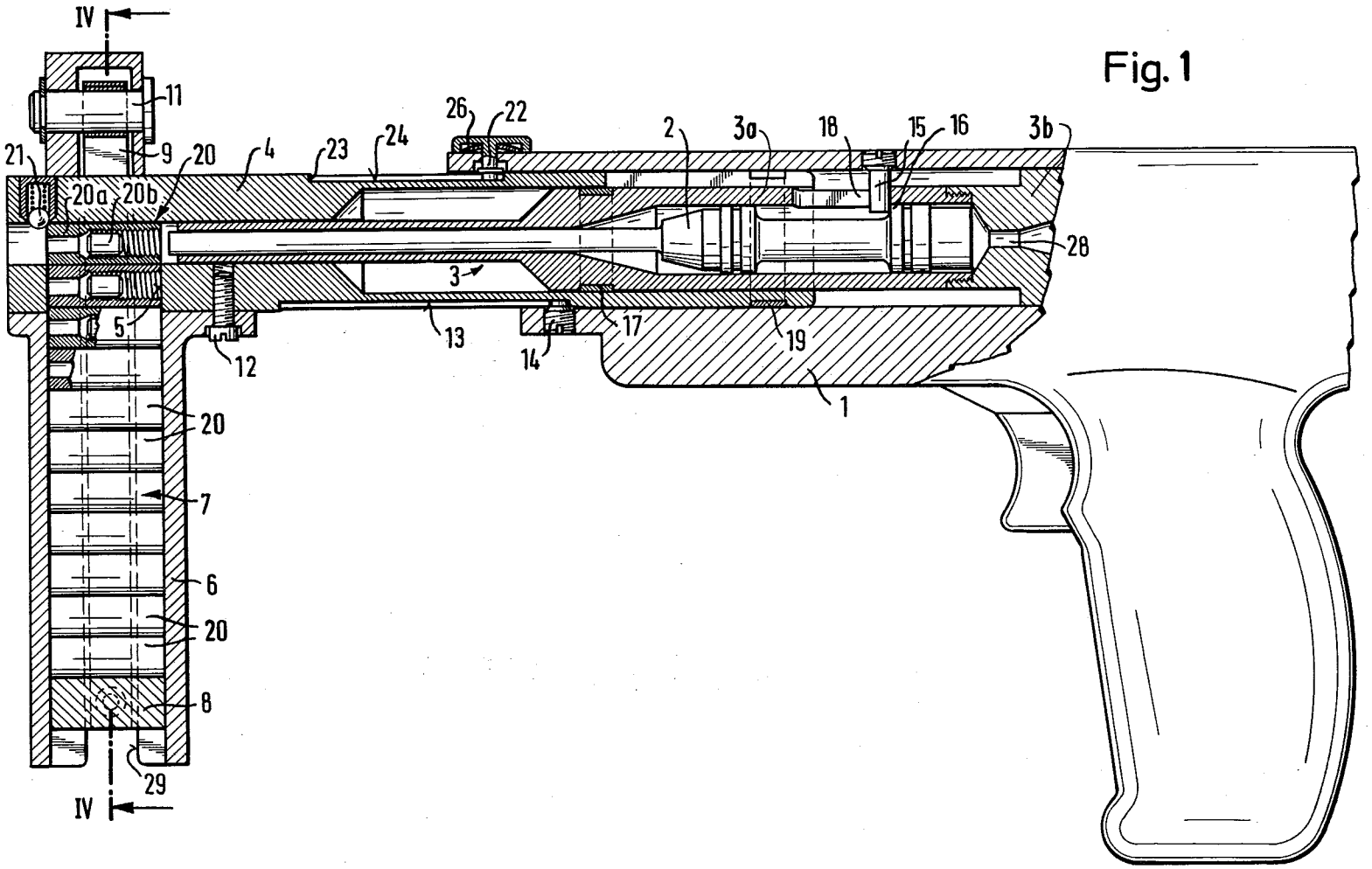
FIG. 1 is a side view of a setting gun, embodying the present invention, and shown partly in section.

In the drawing a known piston-type explosive powder charge driven setting gun is illustrated in combination with a mechanism for feeding expansion anchors into the muzzle end of the gun. In this description the muzzle end of the gun is also described as its forward or front end and this is also applicable to the various parts making up the gun. In other words, those parts of the gun which extend in the firing direction, note FIG. 2 showing an expansion anchor driven into receiving material; the front end of the parts is that end located at or closer to the muzzle end of the gun.

Figures 2, 3:
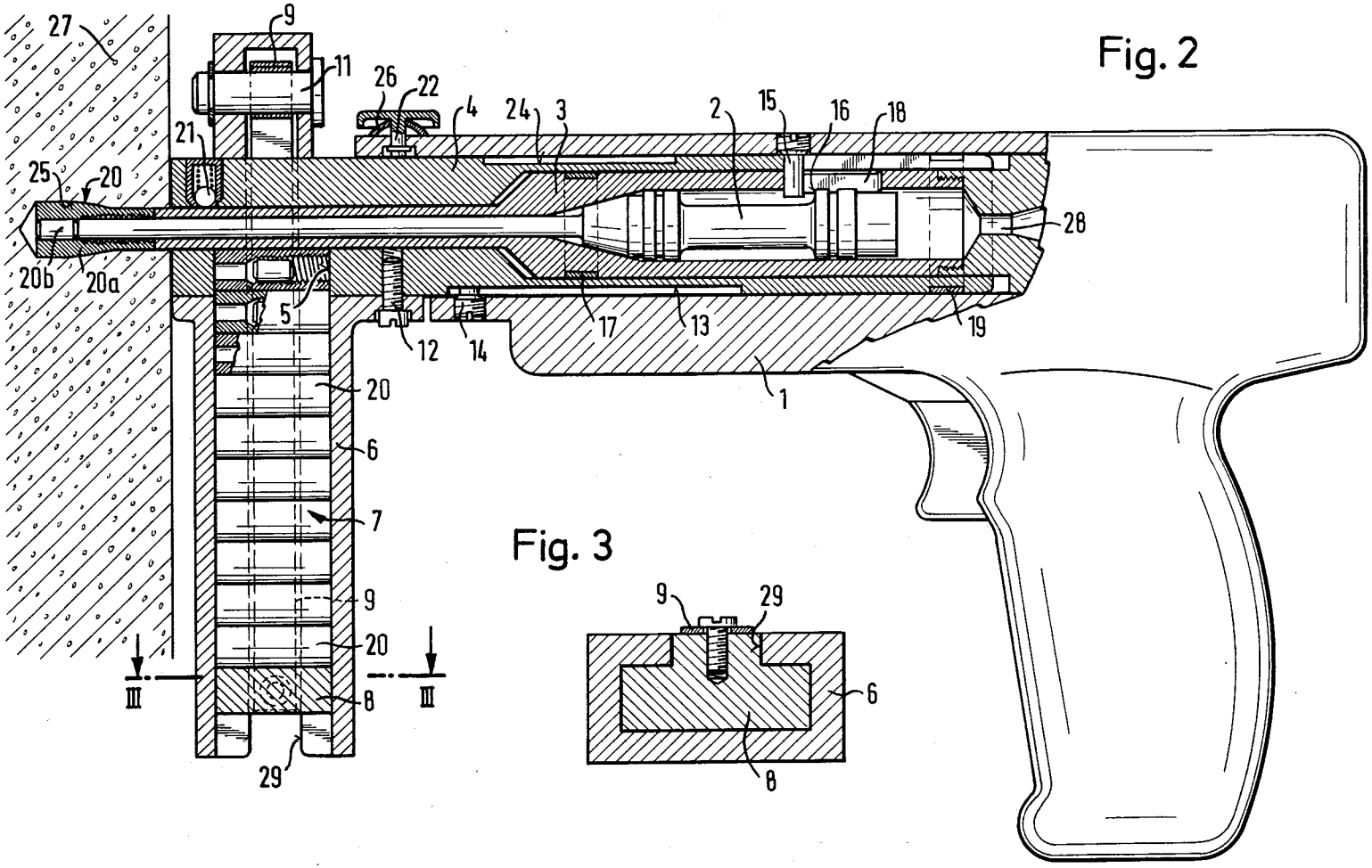
FIG. 2 is a view similar to FIG. 1 showing the setting gun as it drives and secures an expansion anchor into the receiving material.
FIG. 3 is a sectional view taking along the line III-III in FIG. 2.

In FIGS. 1 and 2, the setting gun is shown consisting of a housing 1 having an axially extending bore containing a barrel axially displaceable through the bore. The barrel is formed by a guide member 4 with an axially extending bore within which a piston assembly is also axially displaceable in the firing direction. The piston assembly consists of a piston sleeve 3 axially displaceable within the guide member 4 and a piston 2 contained within the sleeve and axially displaceable relative to the sleeve. The sleeve 3 consists of two longitudinally extending sections *3a, 3b* screwed together to afford the positioning of the piston 2 within the sleeve. The guide member 4 extends forwardly from the end of the housing 1 and forms the muzzle end of the setting gun. As can be seen in FIGS. 1 and 2, the forward end of the piston sleeve 3 extends through the bore in the guide member 4 and in the firing or anchoring position of the gun, projects forwardly of the muzzle or forward end of the guide member, note FIG. 2.

Figure 4:
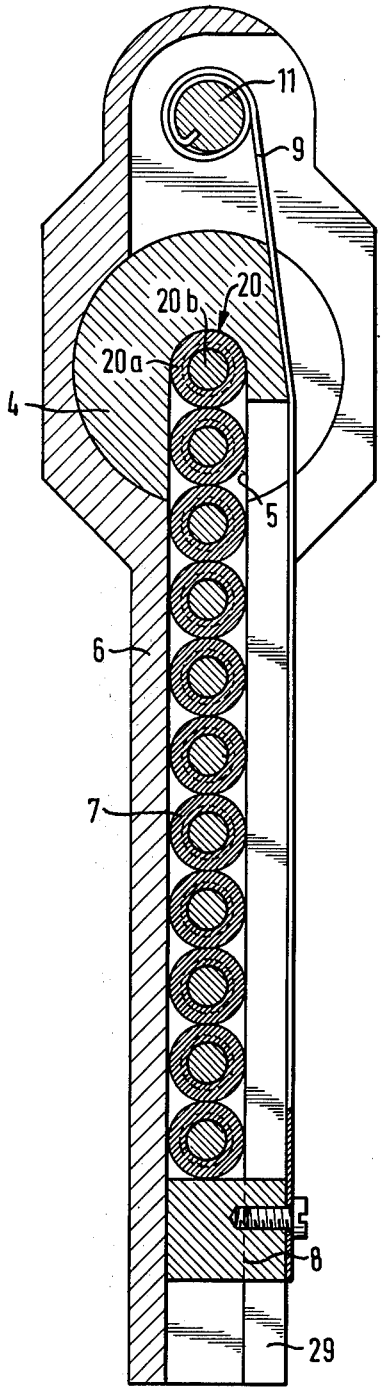
FIG. 4 is a sectional view taken along the line IV-IV in FIG. 1.

Spaced closely from the forward end of the guide member 4 is an inlet opening 5 into the bore in the guide member. A magazine or feed duct 6 communicates with the opening 5 into the guide member. The magazine 6 stores a row 7 of expansion anchors each positioned for insertion by a feeder 8 through the opening 5 into the guide member 4. As can be seen in FIGS. 3 and 4 the feeder 8 is advanced through the magazine 6 toward the guide member 4 by a spring 9. A spring suitable for such purpose is one which is arranged to coil on a shaft 11, note FIG. 4, so that a continued tensioning or pulling action is provided to the feeder for displacing it inwardly through the magazine toward the guide member.

In FIG. 1 the various parts of the setting gun are shown positioned so that an expansion anchor 20 can be inserted into the guide member 4. The loading position is achieved by pulling the feed duct 6, which is attached by a screw 12 to the guide member 4, first manually into the driving position so that the rear end of longitudinal groove 13 in the guide member contacts the stop screw 14 mounted in the housing and extending into the groove. At the same time, another stop member 15 also fixed in the housing 1 and extending radially inwardly toward the center of the barrel contacts the shoulder 16 of the piston 2 and moves it to the rearward position within the piston sleeve 3. As the guide member is pulled forwardly, due to the friction contact of a circular spring 17 mounted on the outer surface of the piston sleeve, the rear end of the slot 18 contacts the stop member 15. In this forward position, the guide member 4 is held by a friction spring 19 in position within the bore in the housing 1.

In the loading position of the setting gun, note FIG. 1, the front end faces of the piston 2 and the piston sleeve 3 are located rearwardly of the rearward end of the opening 5 into the bore in the guide member. Further, the front end face of piston 2 projects forwardly from the front end of the piston sleeve 3. In this position an expansion dowel or anchor 20 can be moved into the guide member 4 from the magazine 6. The expansion anchor consists of an anchor sleeve 20*a* and an expansion element 20*b* which can be axially displaced through the sleeve, however, when initially placed within the guide member the anchor is in its unexpanded condition. When the expansion anchor is loaded into the guide member, it is possible that it could be accidentally displaced through the front end of the guide member. Accordingly, a retaining means 21 in the form of a ball catch is provided extending into the bore forwardly of the position of the expansion anchor as shown in FIG. 1. The ball catch 21 consists of a spring biased ball seated within a recess in the guide member with the biasing action causing the ball to project into the path of the expansion anchor.

Figure 5:
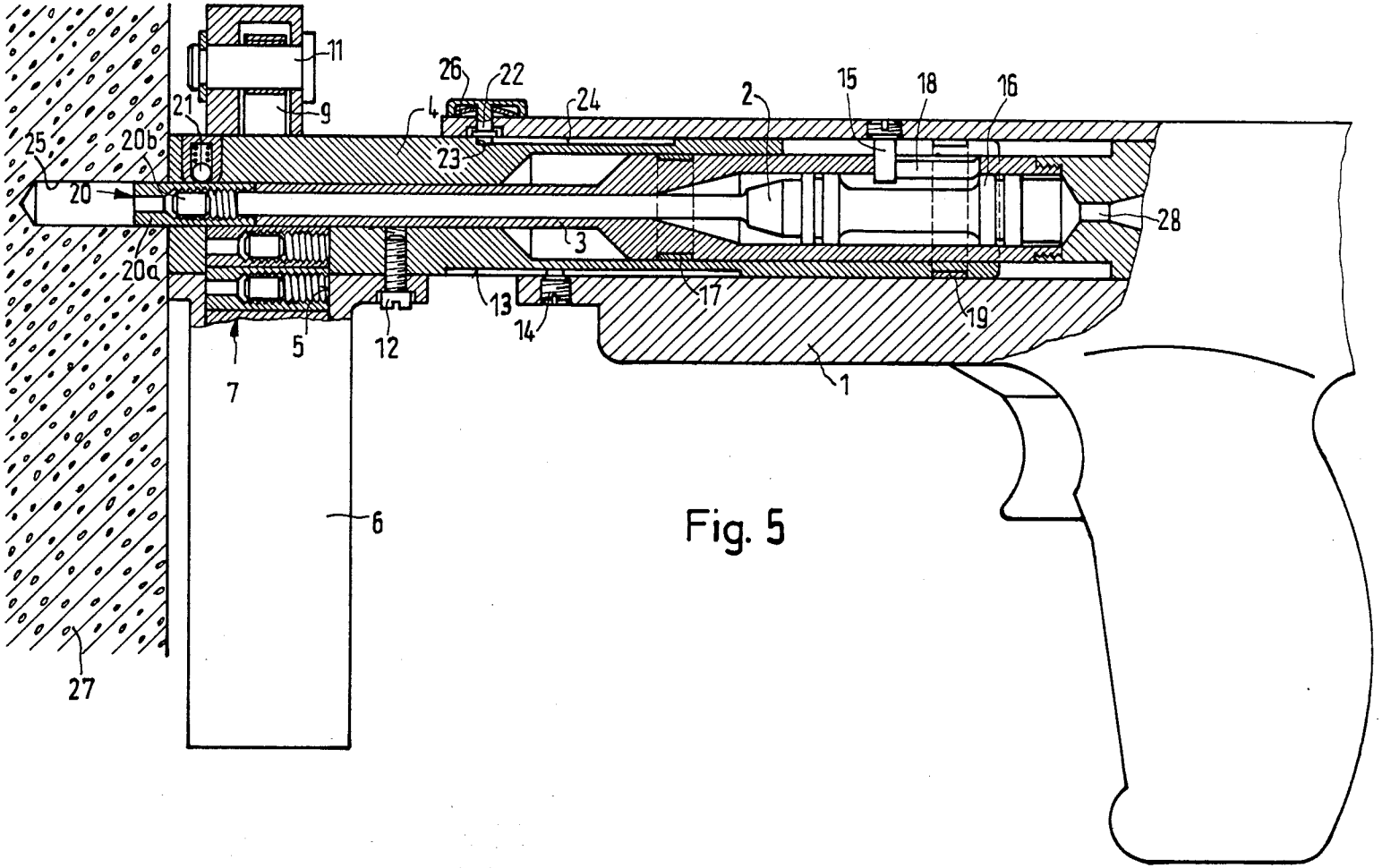
FIG. 5 is a view similar to FIGS. 1 and 2 showing the setting gun displacing the expansion anchor from the gun into a prepared hole.

If the combination of the magazine 6 and the guide member 4 is pushed rearwardly, the piston sleeve 3 is also moved in the rearward direction, due to the friction contact produced by the spring 17, until the front end of the slot 18 in the sleeve strikes against the stop member 15. By further rearward movement of the combined magazine 6 and guide member 4, the expansion anchor 20 is partly ejected by the piston assembly from the front end of the guide member, until a stop pin 22 mounted in the housing, moves into the engaged position with the guide member and strikes against the front end 23 of the groove 24 in the outer surface of the guide member, note FIG. 5.

Figure 6:
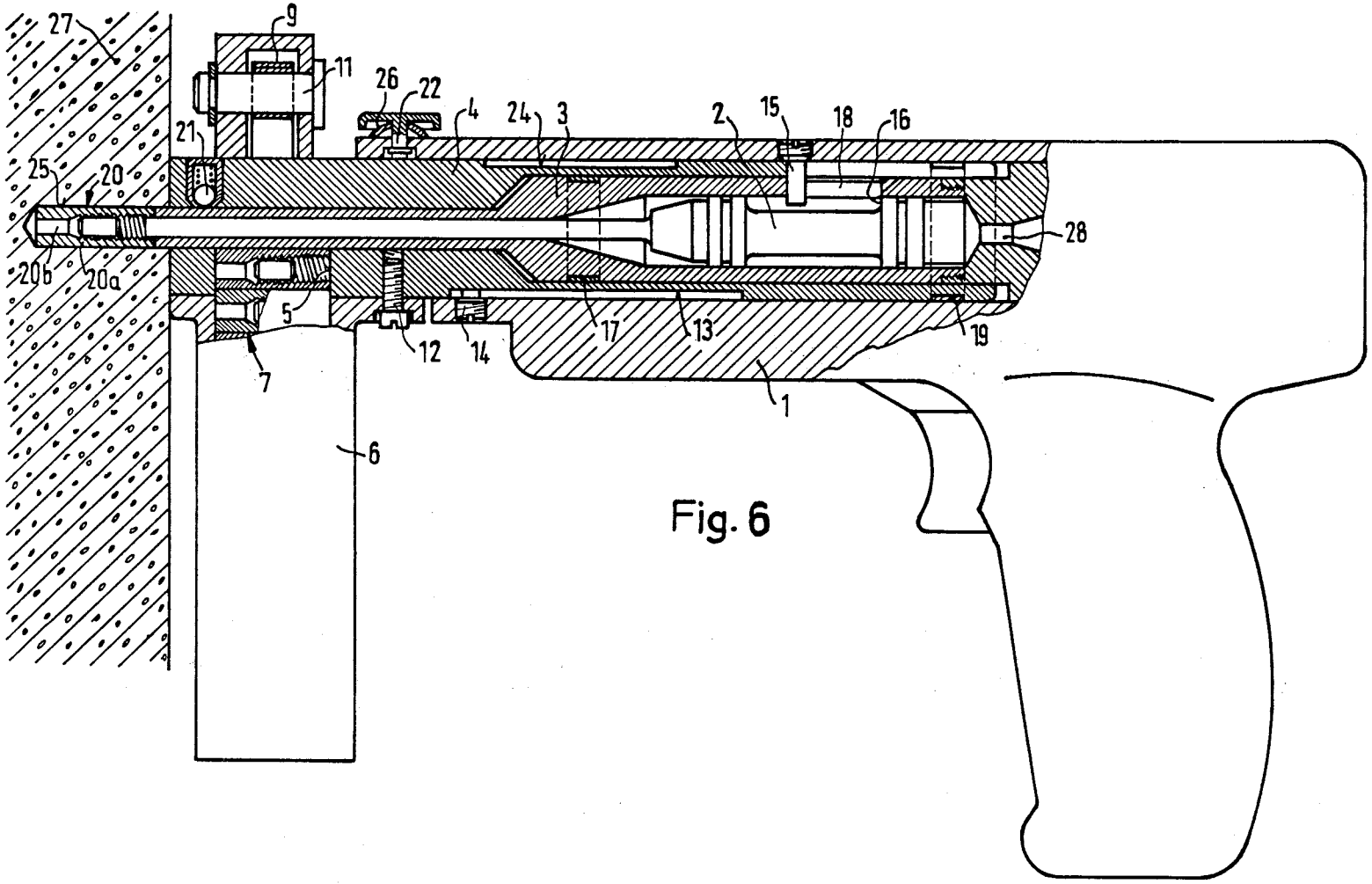
FIG. 6 is a view similar to FIG. 2 with the expansion anchor inserted into the prepared hole but before the expansion element is driven into the anchored position.

With the front end of the expansion anchor projecting from the guide member 4, it can be easily inserted into a prepared hole 25 in the receiving material 27. Subsequently, the stop pin 22 can be disengaged from the groove 24 by means of the relief spring 26, note the position of the stop pin in FIGS. 2 and 6, and it is possible by pressing the front end of the guide member against the receiving material 27 to move the guide member rearwardly over the piston sleeve 3 with the expansion anchor being pushed by the front end of the piston assembly fully into the prepared hole 25, note FIG. 6. Since the front end of the piston 2 projects slightly forwardly of the front end of the piston sleeve 3, it extends into the bore of the expansion anchor 20 and a centering action of the piston within the anchor is attained.

When the expansion anchor positioned at the desired depth within the prepared hole 25, the explosive powder charge, not shown, within the rearward end of the setting gun is ignited. The explosive gases generated by the ignition of the charge, flow through the bore 28 and contact the rear end of the piston 2 propelling it forwardly so that it rides through the piston sleeve and presses the expansion element 20*b* through the anchor sleeve 20*a* into the expanded position. This position of the anchor is shown in FIG. 2 and, as compared to FIG. 6, with the front end of the piston projecting forwardly from the front end of the piston sleeve. The front end of the piston sleeve is held in the rearward position due to its contact with the rear end of the anchor sleeve 20*a*. After an expansion anchor has been completely secured within a prepared hole, the setting gun can be removed from contact with the face of the receiving material and the operation repeated from inserting another expansion anchor into the guide member and for subsequent insertion of the anchor into another prepared hole.

To fill the magazine 6 with expansion anchors, the feeder 8 can be pulled downwardly through the guide groove 29 in the magazine, note the arrangement shown in FIG. 3. As the feeder is pulled away from the guide member 4, the spring 9 attached to it is unwound from the shaft 11. The arrangement of the spring 9 can be seen in FIG. 4. The spring, by the pulling action it effects on the feeder, 8 biases the row 7 of expansion anchors through the passage in the magazine 6 inwardly toward the bore in the guide member 4.

While specific embodiments of the invention have been shown and described in detail to illustrate the application of the inventive principles, it will be understood that the invention may be embodied otherwise without departing from such principles.

We claim:

1. A device for driving an expansion anchor, which includes an anchor sleeve and expansion element positioned within and axially displaceable within the anchor sleeve from a loading position to an anchored position, into a prepared hole in a receiving material, comprising a piston-type explosive powder charge driven setting gun, said gun comprising a housing having an axially extending first bore therein open in the firing direction of said gun, an expansion anchor guide member axially displaceably mounted within the bore in said housing and projecting outwardly from said housing through the open end of said bore, said guide member having an axially extending second bore therein in substantially parallel relationship with said first bore and the end of said second bore facing in the firing direction being open, the second bore arranged to receive an expansion anchor therein in the end facing in the firing direction and first means and second means each axially displaceably mounted within said second bore, said first means being axially displaceable relative to said guide member for inserting the expansion anchor from the second bore into a prepared hole with the expansion element in the loading position within the anchor sleeve, and when the expansion anchor is inserted into the prepared hole said second means being axially displaceable relative to said guide member and to said first means for driving the expansion element in the firing direction axially through said anchor sleeve from the loading position into the anchored position for securing the expansion anchor within the prepared hole.

2. A device, as set forth in claim 1, wherein said first and second means are axially displaceable within said second bore in said guide member between a first position and a second position axially spaced in the firing direction from the first position with said first and second means being manually movable between the first and second positions and said second means being displaceable from the second position when said gun is fired for driving the expansion element into the anchored position, where in the first position said first and second means are spaced axially rearwardly from the open end of said second bore so that an expansion anchor is insertable for its full axial length into said second bore between said first and second means and the open end of said second bore, and in the second position said first means projects outwardly from the open end of said second bore and said second means projects outwardly from said first means.

3. A device, as set forth in clam 2, wherein said first means comprises a sleeve-like piston guide axially displaceably positioned within the second bore in said guide member, said piston guide having a third bore extending axially therethrough in substantially parallel relation with said first and second bores, and said second means comprises an axially extending piston displaceably mounted within said third bore in said piston guide, in the first position of said first and second means said piston extends outwardly from the end of said third bore facing in the firing direction and in the second position of said first and second means said piston extends outwardly from said third bore and said piston guide extends outwardly from the second bore in the firing direction.

4. A device, as set forth in claim 3, wherein a stop member is mounted in said housing, a groove formed in the outer surface of said guide member and arranged to receive said stop member therein for limiting the displacement of said guide member relative to said housing, and said stop member being removable from said groove to afford further displacement of said guide member relative to said housing.

5. A device, as set forth in claim 4, wherein said guide member is tubular.

6. A device, as set forth in claim 3, wherein retaining means are mounted in said guide member and extend into said second bore for preventing an expansion anchor inserted within said second bore from being accidentally displaced from said guide member.

7. A device, as set forth in claim 6, wherein said guide member has a recess extending radially outwardly from the second bore therein, and said retaining means comprises a ball catch held within the recess and spring biased into the path of the expansion anchor located within the second bore for retaining the expansion anchor therein.

8. A device, as set forth in claim 3, wherein said guide member has an aperture therethrough opening laterally into the second bore and said aperture having a length in the axial direction of said second bore sufficient to pass an expansion anchor oriented in the firing direction into said second bore.

9. A device, as set forth in claim 8, wherein a magazine is secured to said guide member and has a passage therethrough shaped to receive and hold expansion anchors with the axial dimension of the expansion anchors extending perpendicularly of the direction of the passage through the magazine, the passage in said magazine being aligned with the aperture in said guide member for supplying expansion anchors into the second bore in said guide member.

10. A device, as set forth in claim 9, wherein a feeder is mounted for movement through said magazine for moving a row of expansion anchors held therein toward said guide member and for feeding individual ones of the expansion anchors into said second bore in said guide member.

11. A device, as set forth in claim 10, wherein a spring is attached to said feeder for biasing said feeder through said magazine toward said guide member.

12. A device, as set forth in claim 3, wherein first stop means are mounted in said housing and extend into a groove in said guide member for limiting the axial movement of said guide member and second stop means are mounted in said housing and extend into slots in said guide member and said piston guide.

* * * * *